United States Patent [19]

Day

[11] Patent Number: 4,605,160

[45] Date of Patent: Aug. 12, 1986

[54] AIR BLENDING APPARATUS FOR HEATING, VENTILATING AND AIR CONDITIONING (HVAC)

[76] Inventor: James L. Day, 7480 Dryer Rd., Victor, N.Y. 14564

[21] Appl. No.: 618,801

[22] Filed: Jun. 8, 1984

[51] Int. Cl.[4] ..... G05D 23/13

[52] U.S. Cl. ..... 236/13; 165/16; 137/111; 137/606; 98/38.7

[58] Field of Search ..... 236/13; 165/16; 98/34.6, 38.7, 38.9; 137/88, 111, 606

[56] References Cited

U.S. PATENT DOCUMENTS

| | | | |
|---|---|---|---|
| 765,423 | 7/1904 | Glantzberg | 236/13 |
| 2,290,096 | 7/1942 | Dale et al. | 236/13 X |
| 3,053,454 | 9/1962 | Waterfill | 137/606 X |
| 3,409,043 | 11/1968 | Warren, Jr. | 137/607 |
| 3,517,881 | 6/1970 | Kohlbeck et al. | 236/13 |
| 4,375,183 | 3/1983 | Lynch | 98/121.2 X |
| 4,383,642 | 5/1983 | Sumikawa et al. | 237/12.3 A |
| 4,408,712 | 10/1983 | Naganoma et al. | 236/13 |

*Primary Examiner*—William E. Tapolcai

*Attorney, Agent, or Firm*—Martin LuKacher

[57] ABSTRACT

Apparatus for blending and destratification of outside and return air streams which are cooled or heated, as by fluid containing heat transfer coils, and discharged into a building. Gates control the flow and blending of outside and inside air in a casing in a region defined at its downstream end by the coils and at its upstream end by the gates which project into the region. The gates are pivotally mounted and vary the volume in the region, and also increase the velocity of air therein to prevent stratification. An array of sensors monitors the temperature of the air passing through the coils and controls the gates, especially when the velocity is low, thereby preventing any freezing of the fluid in the coils which can cause damage. The gates may be panels filled with insulation which provide a seal to protect the coils when the apparatus is not in use. A programmed computer receives inputs from the temperature sensor array and from a discharge air velocity sensor for independently actuating the gates to effect blending, and effect destratification, when destratification is necessary.

26 Claims, 10 Drawing Figures

AIR BLENDING APPARATUS FOR HEATING, VENTILATING AND AIR CONDITIONING (HVAC)

DESCRIPTION

The present invention relates to heating, ventilating and air conditioning systems, and particularly to air blending apparatus for such systems.

The invention is especially suitable for use in a unit which blends outside and return air, which is then heated or cooled and delivered to the building by suitable duct work.

In designing HVAC systems for commercial and industrial applications, it has been common practice to provide duct and damper systems which mix fresh air with return air, condition the air and pump it back into the building through large blower systems (see for example U.S. Pat. No. 765,423, issued July 17, 1904). Fresh air in the proper percentage is a valuable source of free cooling potential with which to offset internal heat gains generated by machines, lights, personnel and other heat generating processes within the building.

In early air conditioning systems, large doors were employed as diverting gates or mixing valves for the air streams (see for example, U.S. Pat. No. 2,286,749, issued June 16, 1942). As air conditioning systems became more sophisticated, multi-section, multi-blade, damper assemblies were applied with automatic modulating control systems to control the percentages of outside air and return air with respect to each other to maintain a reasonably constant quality of air in the building (see for example, U.S. Pat. Nos. 4,044,947 issued Aug. 30, 1977 and 4,294,403 issued Oct. 13, 1981). The control damper assemblies in virtually all air conditioning and heating and ventilating applications presently employ parallel or opposed multi-blade, multi-section dampers.

With such systems a difficult problem which still remains is the control of stratification within the air-handling unit itself. It is common for such units to be ten to fifteen feet high and wide, thereby having a large space in which stratification can take place. With large differential temperatures between the outside air and return air, as the air enters the mixed air plenum, it tends to stratify and can cause the fluid-filled heat transfer coils to freeze and burst or cause other kinds of temperature distribution problems within the equipment. Multi-blade, multi-section dampers also leak and allow the entry of sufficient cold air to cause freezing.

There have been a number of destratification techniques which have been used in the past. Air screw turbulators have been installed. Complex designs of multiple inlets for outside and return air into the plenum have been tried. Also, opposed air streams have been directed at each other at high velocities. These techniques have not been totally satisfactory in that energy is consumed to cause turbulation of the air streams and produce a mixing or blending action within the mixed air plenum, and at all times; not just when destratification is needed.

The stratification problem has been exacerbated by a major shift in the design of HVAC systems from those which handle a constant volume of air to those which tend to reduce the amount of air handled, as the cooling load decreases. Consequently, the velocity of the air in the mixing plenum actually reduces, causing the above-mentioned, existing types of destratification equipment to loose their effectiveness. Sufficient velocity of the air is not provided when the temperature decreases and when destratification is needed the most.

It is the principal object of the present invention to provide improved air blending apparatus which accomplishes destratification efficiently and effectively, even when the air velocity is low (as when the cooling load decreases).

It is another object of the present invention to provide air blending apparatus which seals the building at the HVAC equipment to reduce infiltration losses and the risk of freezing the heat transfer (air conditioning and heating) coils of the system, thereby reducing the disadvantages of multi-section, multi-blade dampers which have the tendency to leak.

It is a further object of the present invention to provide improved HVAC apparatus which provides blending and destratification control automatically and with minimal increase of energy.

Briefly described, air conditioning apparatus embodying the invention uses a casing having inlet openings for outside air and for return air. Heat transfer coils are disposed across the casing. A variable volume air blending region (or mixing plenum) in the casing is located between the inlets and the coils. The region is defined by first and second gates extending into the region which control the flow and distribution of air from the outside air and return inlets, and the velocity of the air in the air blending region or plenum. These gates are controlled in position in response to the detection of conditions indicative of the stratification of the air in the region across the coils to prevent such stratification. The gates operate by increasing the velocity of the air into the region for destratification, while providing sufficient control of the air streams with minimal pressure drop in the casing for blending of the streams when destratification is not needed. The gates may be panel dampers pivotally mounted to the casing which is divided by a partition from the inlets to the region. The gates may be insulating material filled, so as to provide a seal for closing the unit against infiltration of air when it is not in use. A programmed computer, such as a microprocessor, monitors the temperature of the air along strata vertically spaced from each other and also monitors the velocity of the discharge air from the casing. The average temperature is used to control blending while the lowest temperature is detected and initiates a destratification routine to decrease the distance between the dampers, as by pivoting them toward each other and increasing the velocity of air in the region to effect destratification.

The foregoing and other objects, features and advantages of the invention as well as a presently preferred embodiment thereof, will become more apparent from a reading of the following description in connection with the accompanying drawings in which.

Figures 1, 1A:
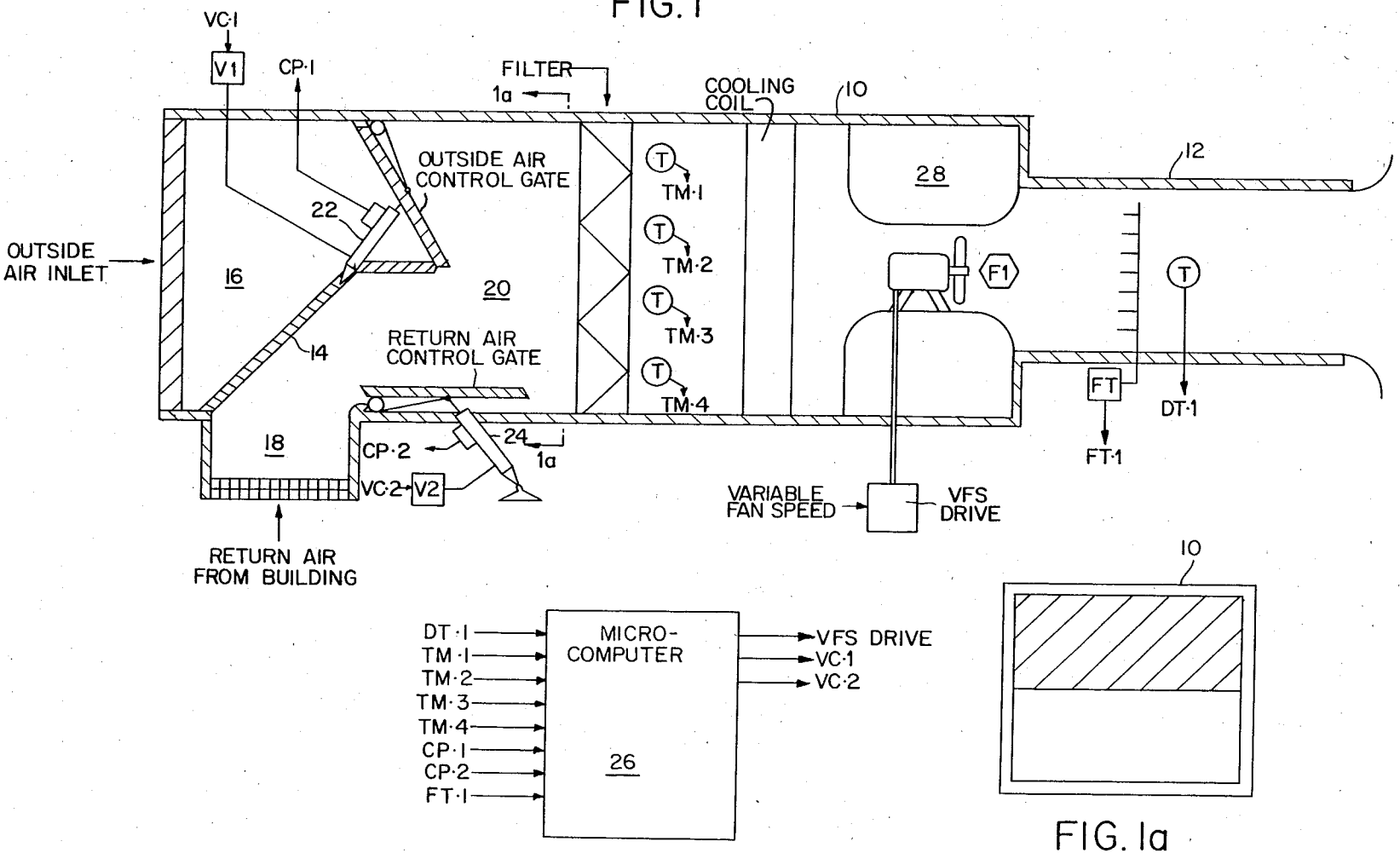
FIG. 1 is a diagrammatic view of HVAC apparatus embodying the invention, the view including a cross-section through the air-blending apparatus thereof.

Referring to FIG. 1 there is shown a casing 10 having inside and return air openings at inlets thereto and an outlet duct 12 therefrom which may be connected to the duct work in the building in which the apparatus is installed. The casing is rectangular in cross-section. A partition 14 divides the inlet portion of the chamber into compartments or channels 16 and 18 extending from the outside air inlet and the return air inlet in a downstream direction towards the outlet of the casing 10. This partition extends from the inlet end of the casing in the direction of the outlet.

An outside air control gate controls the flow of air from the outside air compartment. A return air control gate controls the flow of air from the return air compartment. These gates are dampers which are pivotally mounted to the casing and extend into a region 20 of the casing. This region 20 is between the gates and heat transfer coils, which are indicated as cooling coils in the drawing. The region comprises the mixing plenum. The coils extend across the casing. They may be filled with chilled water for cooling and heated water for heating. Inasmuch as the gates extend into the region 20, they vary the volume of the region in accordance with the position thereof. This variable volume controls the blending and provides for an increase of velocity in the region so as to effect destratification of the air therein.

The gates themself are preferably panels shaped to correspond to the cross-section of the outlets of the inside and return air compartments 16 and 18 defined by the partition 14 and the walls of the casing. In a preferred embodiment, the cross-section of the panels is rectangular. The panels may be made of insulating material and may be provided with gaskets which bear against the walls of the casing and the end of the partition to effect a seal. Suitably, the panels may be hollow metal (aluminum) with a filling of insulating material, such as polyurathene.

Separate actuators are used to position the gates. These actuators may be any suitable actuator. In this prefered embodiment of the invention they are pneumatic cylinders 22 and 24 having pistons pivotally connected to the gates. The ends of the cylinders may also be pivotedly mounted. Air is supplied through valves V1 and V2. Air supply and vent lines to the valves are not shown to simplify the illustration. The valves are controlled by control signals VC-1 and VC-2 from a controller 26 which is suitably a programmed computer such as a micro-computer with an output interface which provides the signals VC-1 and VC-2 as control levels to open and close the valves V3 and V2 between the supply and vent lines for the pressurized air. The position of the gates is detected by position transducers which provide outputs CP-1 and CP-2. These signals also go to the micro-computer where they may be digitized and used as feedbacks to indicate the position of the gates for control purposes.

A conventional filter is located in the region between the gates and the cooling coil. An array of temperature sensors, "T", are disposed vertically spaced from each other across the casing to detect the temperature in vertically spaced strata of the region 20. These temperature sensors provide output signals TM-1 through TM-4 to the computer controller 26.

Air is impelled through the discharge end of the casing by a motor driven fan F-1 which is mounted on baffles 28 at the outlet or discharge end of the casing 10. The motor may be a variable speed motor operated by a variable speed drive circuit (VSF DRIVE), which receives a VSF drive signal from the computer controller.

The discharge or outlet end of the casing has a velocity sensor which is connected to a flow transmitter, FT, which produces an output flow signal FT-1 to the computer comptroller. The temperature of the outlet air is also detected by a temperature sensor, "T", which provides an output signal DT-1 to the computer controller 26.

With the control gates positioned as shown in FIG. 1, the outside air control gate being closed completely and the return air gate being open, the apparatus may be inoperative or in an off condition. The areas defined by the gates is shown in FIGS. 1*a* to 5*a*, with the end of the partition 14 as a line to simplify the drawing and with the gates criss-cross hatched so that they can be distinguished from the open areas. Then the outside air control gate provides an envelope seal to protect the coils from freezing due to infiltration of cold air from the outside of the building. The system then has the capability to operate on 100% return air when that capability is desired to warm up or cool down or maintain the temperature in the building without utilizing outside air.

Figures 2, 2A:
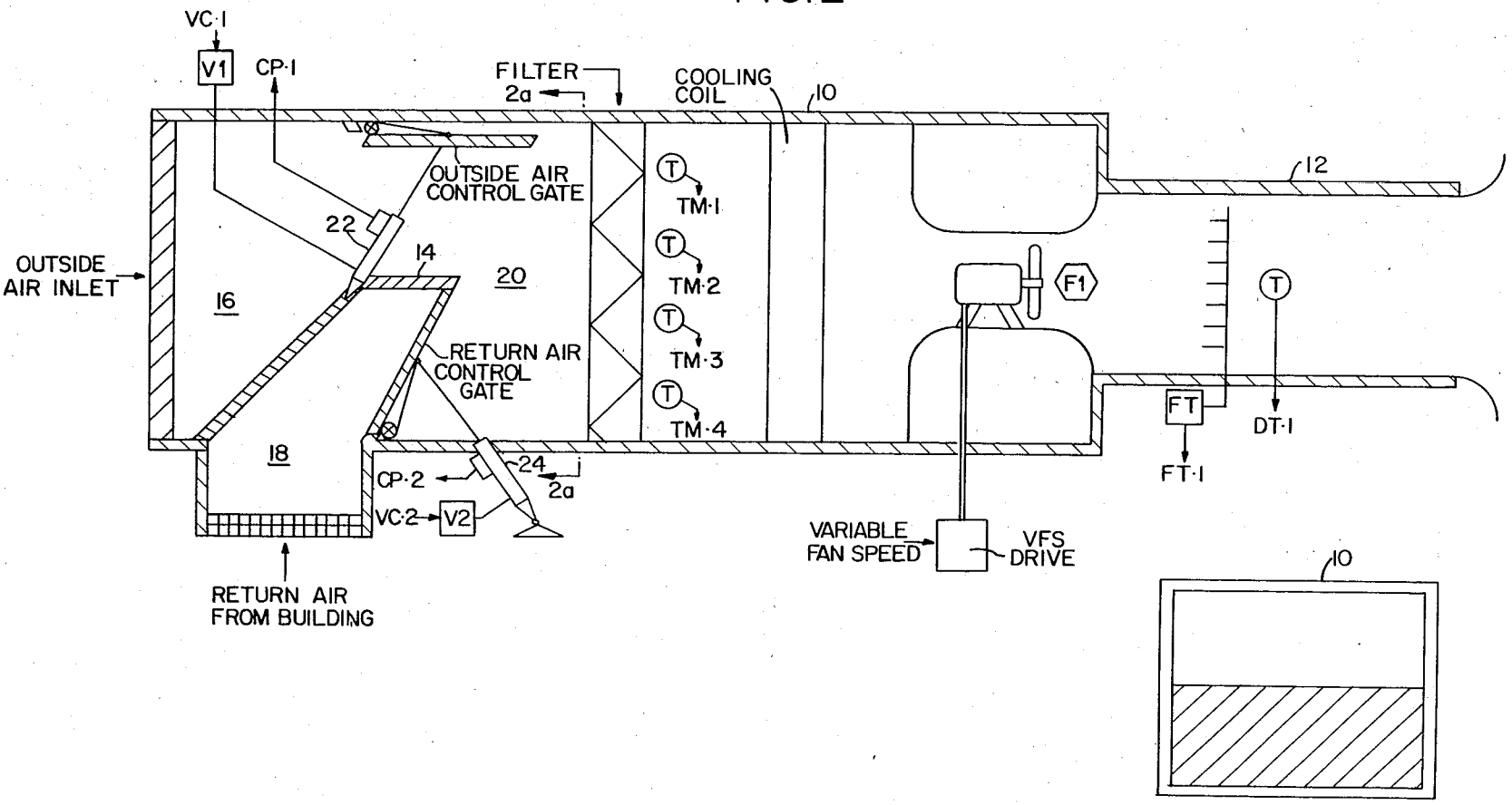
FIGS. 2–5 are views of the air-blending apparatus shown in FIG. 1, in different operating conditions; and FIGS. *1a–5a*, respectively, are diagrammatic sectional views along the lines *1a—1a* in FIG. 1, *2a—2a* in FIG. 2, *3a—3a* in FIG. 3, *4a—4a* in FIG. 4, and *5a—5a* in FIG. 5.

FIG. 2 and FIG. 2*a* show the condition of the apparatus when 100% outside air is used for cool down or maintenance of temperatures during periods when a cooling load is presented in the air-conditioned space (the building). In both the condition shown in FIG. 1 and FIG. 2, the velocity and temperature signals FT-1 and DT-1 are utilized by the micro-computer controller 26 to provide the programmed amount of air flow by controlling the speed of the fan F-1 accordingly.

Figures 3, 3A:
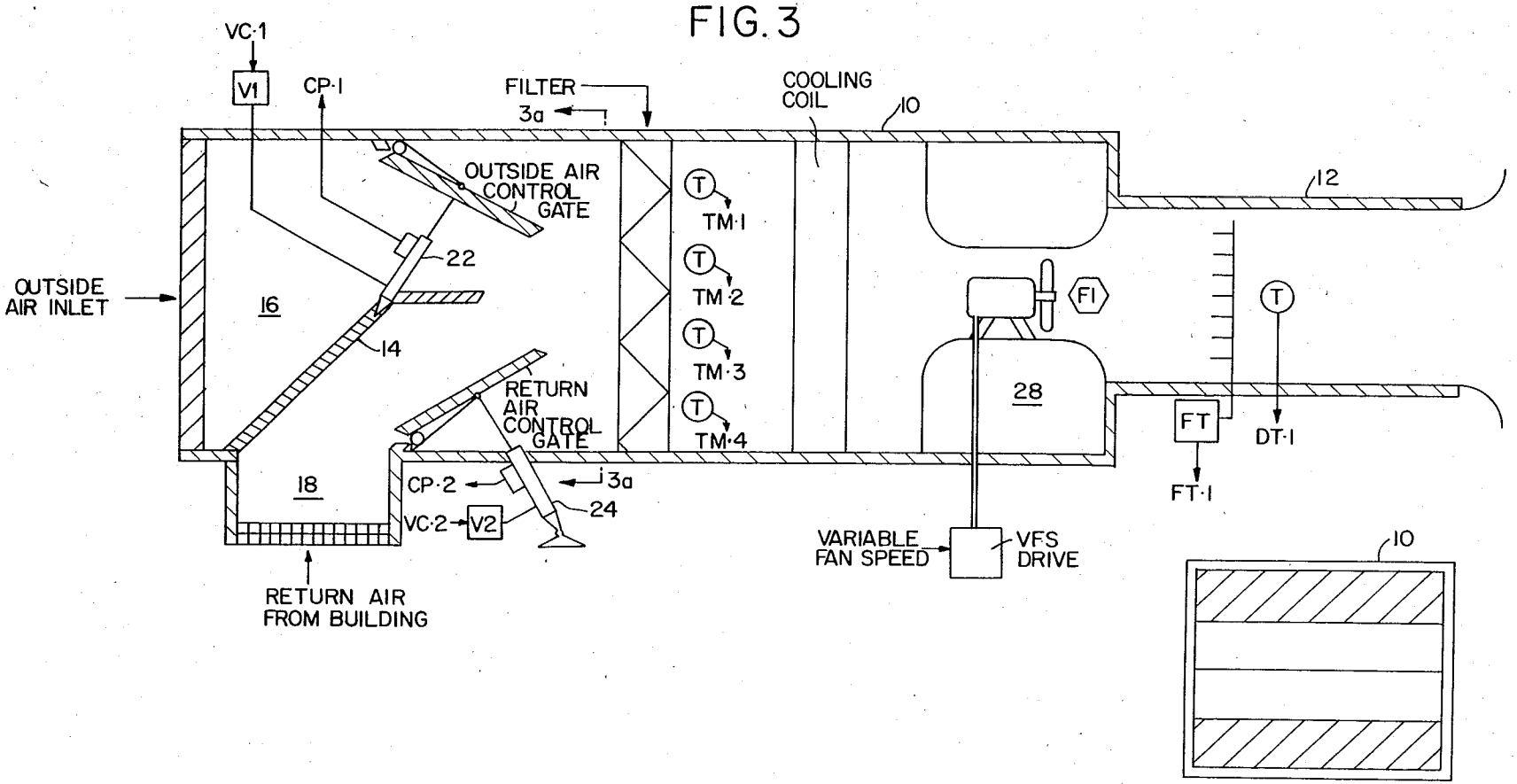

FIG. 3 and FIG. 3*a* show the condition of the apparatus for 100% air flow, when there is a requirement for 50% outside air and 50% return air, but without any requirement for destratification. The gates provide sufficient control of the air streams entering the region without any unnecessary pressure drop to effect destratification. Under these conditions the average temperature (obtained by averaging the outputs represented by the signals TM-1 through TM-4) is used to control the position of the gates. The velocity signals FT-1 and DT-1 may also be used to control the speed of the fan F-1.

Figure 4:
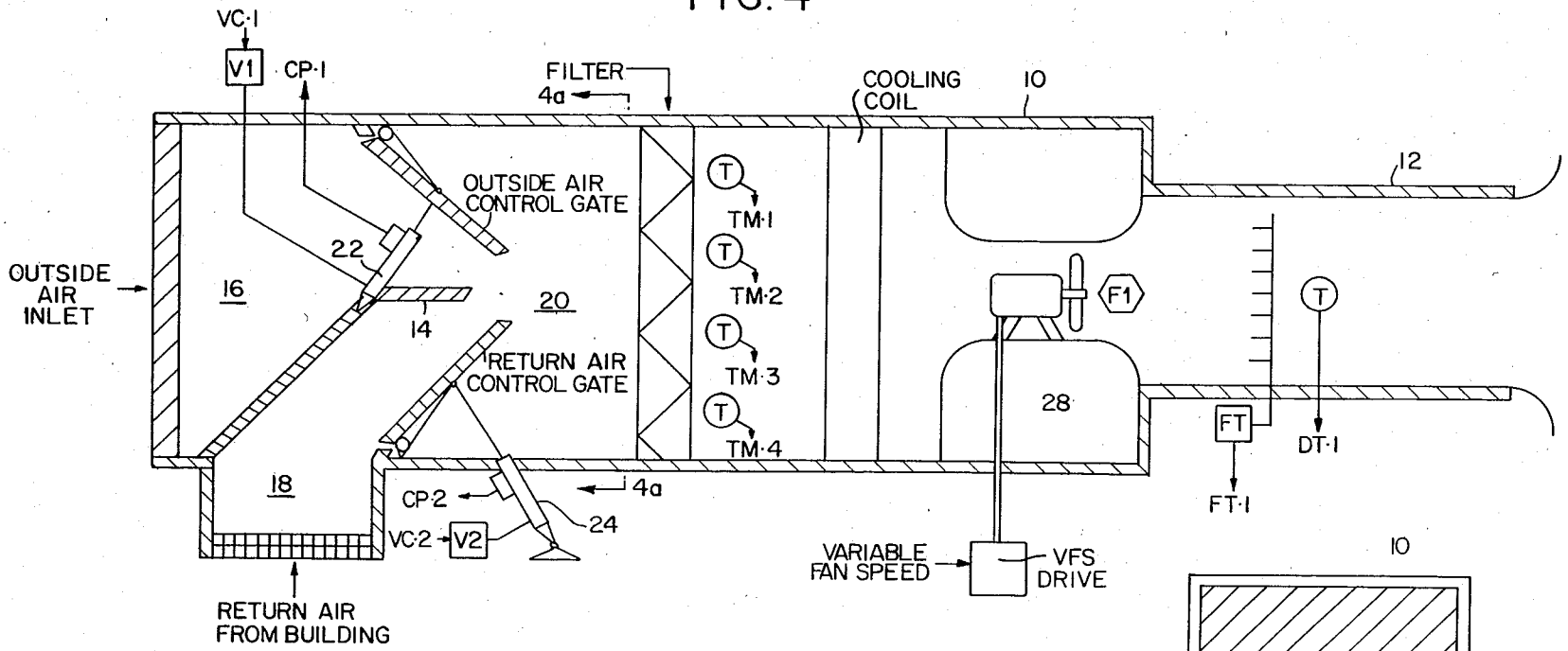
Figure 4A:
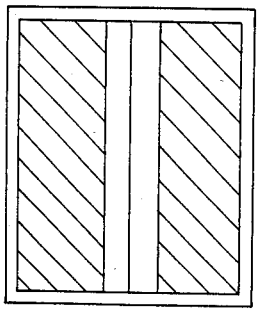

FIG. 4 and FIG. 4*a* show the condition of the system where there is a requirement for destratification as represented by the temperature outputs TM-1 through TM-4. The computer responds to the lowest of these outputs. The low temperature which initiates a destratification routine may be a temperature which is close to the freezing temperature of the fluid in the coils. Then, the gates are pivoted toward each other and decrease the distance there between. They also reduce the volume in the region 20 of the casing 10 defined between the gates and the coil. The velocity of the air in the region, because of the confined space through which the air must flow is increased, for example, from 1,000 to 2,000 feet per minute (fpm). In the event that the increase of velocity is insufficient, as detected by the Flow Transmitted FT, the fan speed may be increased. In other words, the free area between the control gates is controlled in response to temperature and flow velocity, as is detected by the temperature and flow transmitters, so as to effect destratification.

Figure 5:
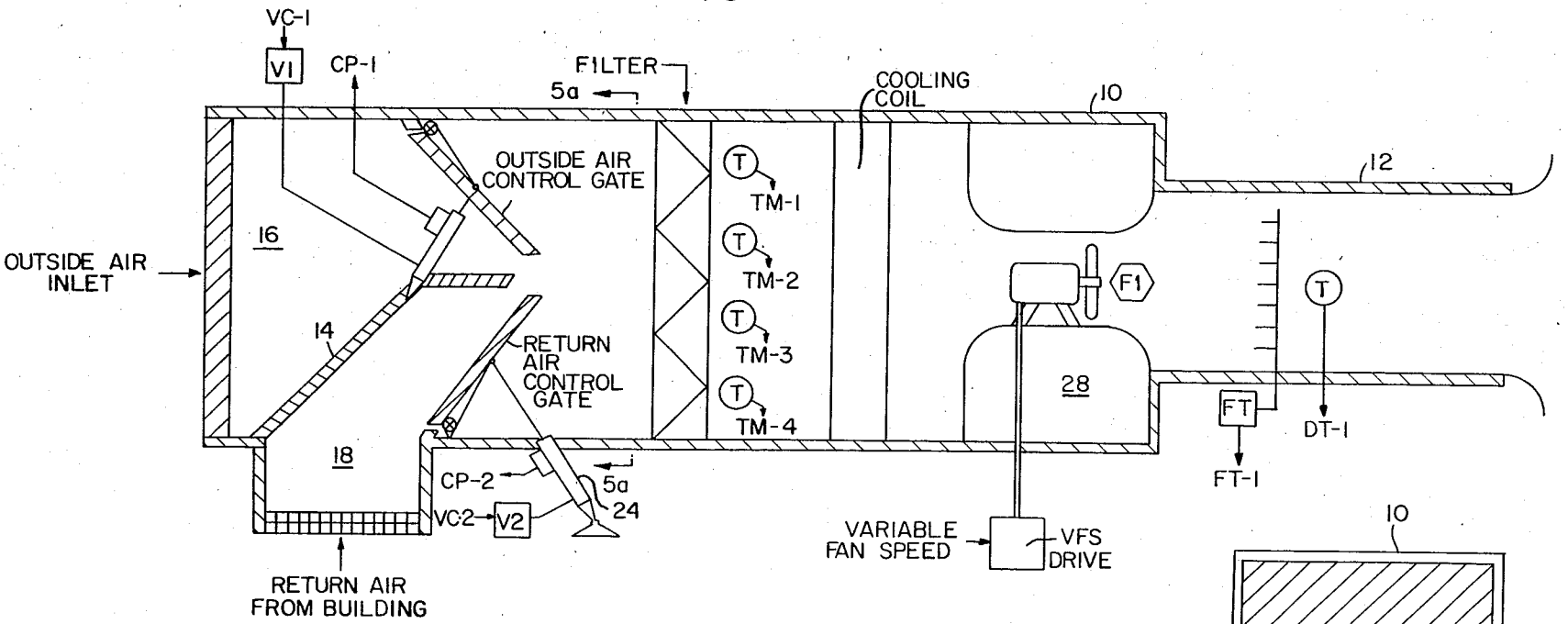
Figure 5A:
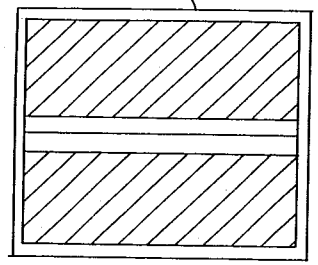

FIG. 5 and FIG. 5*a* illustrates the condition where the air volume has been reduced from 100% to 50% of rated capacity. The gates are brought even closer together in response to the lowest temperature output, TM-1 through TM-4, and the discharge velocity signal FT-1 to implement destratification and protect the cooling coil.

From the foregoing description it will be apparent that there has been provided improved HVAC apparatus which is especially suitable for mixing outside and return air streams in a manner to prevent stratification of the air in heat transfer coils which may cause freezing and damage to the coils. Variations and modifications in the herein described apparatus, within the scope of the invention, will undoubtedly suggest themselves to those skilled in the art. Accordingly, the foregoing description should be taken as illustrative and not in a limiting sense.

I claim:

1. Air-blending apparatus comprising a chamber having a first inlet for outside air and a second inlet for return air and an outlet, a partition dividing a portion of said chamber adjacent to said inlet into first and second compartments, said partition extending from inlet ends of said compartments near said first and second inlets in the direction of said outlet to outlet ends of said compartments, first and second dampers pivotally mounted in said chamber on opposite sides of said partition, said dampers being rotatable into and out of closing engagement with said oulet ends of said compartments, said dampers defining a region of said chamber on opposite sides of said partition and between said outlet ends thereof and the outlet of said chamber of volume variable in accordance with the position of said dampers, means responsive to conditions representing stratification of the air in the vicinity of said outlet of said chamber, and means responsive to said last-named means for controlling the position of said dampers whereby to prevent stratification of the air in the vicinity of said outlet of said chamber.

2. The apparatus according to claim 1 wherein said last-named means comprises air velocity sensor means responsive to the velocity of air from said outlet, and said controlling means comprises means responsive to said air velocity sensor means for increasing the velocity of said air in said region with said dampers for prevention of stratification in said region.

3. The apparatus according to claim 2 wherein said controlling means includes means operative to pivot said dampers toward each others to increase the velocity of said air in said region.

4. The apparatus according to claim 2 wherein said controlling means includes means for controlling the pivoting of said dampers to decrease the distance therebetween whereby to increase the pressure drop in said region and the velocity of said air therein.

5. The apparatus according to claim 1 wherein said last-named means comprises temperature sensor means spaced from said dampers in the direction of said aoutlet, said controlling means being responsive to said sensor means for increasing the velocity of air in said region with said dampers for prevention of stratification in said region.

6. The apparatus according to claim 5 wherein said last-named means further comprises velocity sensor means responsive to the velocity of air from said outlet, said contolling means being responsive to said temperature sensor means also being responsive to said velocity sensor means for actuating said dampers to increase the velocity of air in said region for prevention of stratification in said region.

7. The apparatus according to claim 6 wherein said controlling means responsive to said temperature and velocity sensor means includes programmed computer means.

8. The apparatus according to claim 5 wherein said temperature sensor means comprises an array containing a plurality of temperature sensors vertically spaced from each other and providing a plurality of outputs representing the temperature of a plurality of vertically spaced strata across said chamber, and said outputs being indicative of the stratification of the air in said region.

9. The apparatus according to claim 8 wherein said means responsive to said temperature sensor means includes means responsive to the one of said outputs which represents the lowest temperature.

10. The apparatus according to claim 9 wherein said means responsive to said temperature sensor means includes means responsive to all of said plurality of outputs for controlling said dampers in accordance with the average temperature of said air in the absence of stratification.

11. The apparatus according to claim 8 wherein heat transfer means is disposed in said chamber between the outlet thereof and said temperature sensor array.

12. The apparatus according to claim 11 further comprising fan means of the outlet of said chamber, air velocity sensor means responsive to the flow of air discharged from said chamber at the outlet of said fan means, said controlling means also being responsive to said velocity sensor means, and means responsive to said velocity sensor means for controlling the speed of said fan means.

13. The apparatus according to claim 12 further comprising temperature sensor means responsive to the temperature of said air discharged from said chamber and disposed downstream of said fan means, said fan speed control means also including means responsive to said discharge air temperature sensor means.

14. The apparatus according to claim 13 further comprising programmed computer means comprising said controlling means for said dampers and said fan speed control means, said output from said temperature sensor array, said velocity sensor means and said discharge temperature sensor being input connected to said computer means, and said damper actuating means and said fan speed control means being output connected to said computer means.

15. The apparatus according to claim 1 wherein said dampers are each panels.

16. The apparatus according to claim 15 wherein said panels contain bodies of insulating material.

17. The apparatus according to claim 1 wherein said controlling means includes means for pivoting said first and second dampers independently of each other.

18. The apparatus according to claim 17 wherein said pivoting means comprises a first actuating cylinder connected to said first damper and a second actuating cylinder connected to said second damper, and means for applying actuating power independently and selectively to said first and second cylinders.

19. Air conditioning apparatus comprising a casing having inlet openings for outside air and for return air, heat transfer coils disposed across said casing, a variable volume air blending region in said casing between said inlet openings and said coils, said region being defined by first and second gates extending into said region for controlling the flow and distribution of air from said outside air and return air inlet openings, means for sensing stratification of air conditions across said coils, and means responsive to said sensing means for controlling the position of said gates in response to the stratification of air in said region across said coils to prevent such stratification.

20. The apparatus according to claim 19 wherein said gates are panels pivotally mounted to open and close channels into said region from said inlet openings.

21. The apparatus according to claim 20 wherein the panels have opposite ends, one of which extends into said region and the other which is pivotally mounted.

22. The apparatus according to claim 21 wherein said panels are filled with insulating material.

23. The apparatus according to claim 21 further comprising individually and separately operable actuator means connected to each of said panels for pivoting said panels.

24. The apparatus according to claim 19 wherein said sensing means comprises an array of temperature sensors for sensing the temperature in a plurality of strata spaced across said coils.

25. The apparatus according to claim 24 wherein said sensing means further comprises means for sensing the velocity of discharge air from said casing which passes through said coils.

26. The apparatus according to claim 25 wherein said controlling means further comprises a programmed computer having inputs from said temperature sensors and velocity sensor means and providing position control outputs to said gates.

* * * * *